US010619376B2

(12) United States Patent
Hoffmann

(10) Patent No.: US 10,619,376 B2
(45) Date of Patent: Apr. 14, 2020

(54) DEVICE FOR ATTACHING FLEXIBLE FABRICS FOR INDOOR AND OUTDOOR USE IN ARCHITECTURE

(71) Applicant: Roland Hoffmann, Igersheim (DE)

(72) Inventor: Roland Hoffmann, Igersheim (DE)

( * ) Notice: Subject to any disclaimer, the term of this patent is extended or adjusted under 35 U.S.C. 154(b) by 0 days.

(21) Appl. No.: 16/177,553

(22) Filed: Nov. 1, 2018

(65) Prior Publication Data

US 2019/0128013 A1 May 2, 2019

(30) Foreign Application Priority Data

Nov. 2, 2017 (DE) ..... 20 2017 106 630 U

(51) Int. Cl.
*E04F 13/00* (2006.01)
*E04H 15/64* (2006.01)

(52) U.S. Cl.
CPC ..... *E04H 15/648* (2013.01); *E04F 13/005* (2013.01); *E04H 15/644* (2013.01); *E04H 15/646* (2013.01)

(58) Field of Classification Search
CPC .. E04F 13/005; E04F 13/26; Y10T 24/44043; Y10T 24/44051
USPC ..... 52/63, 222, 291, 745.21; 160/368.1
See application file for complete search history.

(56) References Cited

U.S. PATENT DOCUMENTS 3,553,862 A * 1/1971 Hamu ..... B41F 15/36 38/102.1
3,788,216 A * 1/1974 Lambert ..... B41C 1/14 101/127.1
4,192,112 A * 3/1980 Reilly, Sr. ..... E04F 10/02 160/46
4,404,962 A * 9/1983 Zinn ..... F24S 80/52 126/676
4,817,317 A * 4/1989 Kovalak, Jr. ..... G09F 13/04 40/549
5,140,765 A * 8/1992 King ..... G09F 15/0025 40/574
5,333,425 A * 8/1994 Nickerson ..... E04H 15/18 160/383
7,810,545 B2 * 10/2010 Bernardi ..... E04B 9/303 160/328
8,985,183 B2 * 3/2015 Terry ..... E06B 9/24 160/371
9,334,644 B2 * 5/2016 Harnois ..... E04H 15/644
10,036,198 B2 * 7/2018 James ..... E06B 9/0692
10,174,507 B1 * 1/2019 Henbid ..... E04F 13/005
10,322,870 B1 * 6/2019 Knight ..... B65D 88/127
(Continued)

FOREIGN PATENT DOCUMENTS

DE 3310895 C2 * 5/1987 ..... E04H 15/642
DE 202009012638 U1 * 1/2010 ..... E04F 13/005
(Continued)

OTHER PUBLICATIONS 2 page PDF of machine translation of FR 2354046 A1. (Year: 1978).*

*Primary Examiner* — Robert Canfield
(74) *Attorney, Agent, or Firm* — Smartpat PLC

(57) ABSTRACT

A device for attaching flexible, flat fabrics includes at least one keder rail having a keder channel in which a keder core attached to the fabric is inserted. The device includes at least one receiving profile in or on which the at least one keder rail is arranged relocatable at an adjustable height.

12 Claims, 2 Drawing Sheets

(56) References Cited

U.S. PATENT DOCUMENTS

| | | | | |
|---|---|---|---|---|
| 2010/0037544 | A1* | 2/2010 | Musgrave | E04H 15/18 52/222 |
| 2013/0092334 | A1* | 4/2013 | Terry | E06B 9/24 160/368.1 |
| 2015/0020473 | A1* | 1/2015 | Fox | E04H 15/322 52/712 |
| 2015/0233107 | A1* | 8/2015 | Harnois | E04H 15/644 52/63 |
| 2016/0230391 | A1* | 8/2016 | Fox | E04H 15/642 |

FOREIGN PATENT DOCUMENTS

| | | | | |
|---|---|---|---|---|
| DE | 102012200960 | A1 * | 7/2013 | E04F 13/005 |
| DE | 1020112200960 | * | 7/2013 | E04F 13/005 |
| DE | 202013004020 | U1 * | 8/2013 | E04H 15/644 |
| DE | 102013225510 | A1 * | 6/2015 | E04H 15/644 |
| EP | 0021834 | A1 * | 1/1981 | A01G 9/1515 |
| FR | 2354046 | A1 * | 1/1978 | A01G 9/4107 |

* cited by examiner

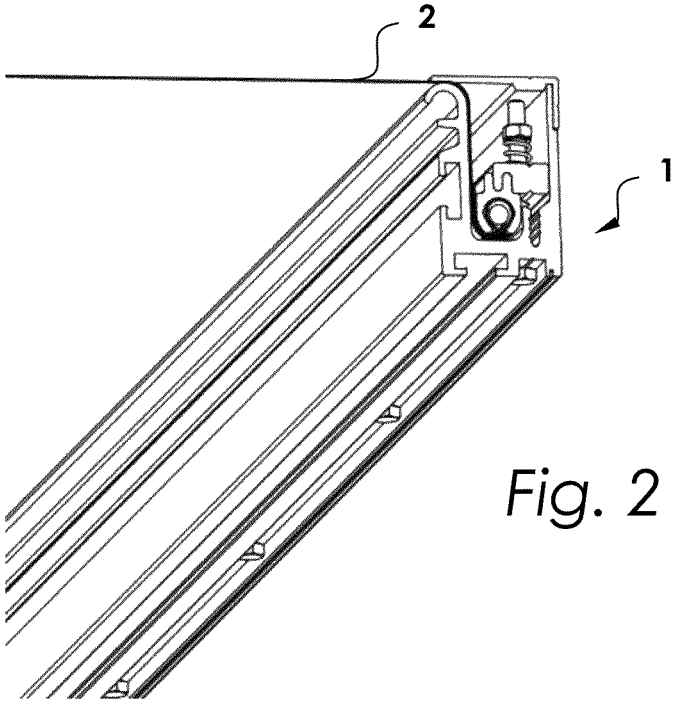
Fig. 2
Fig. 3
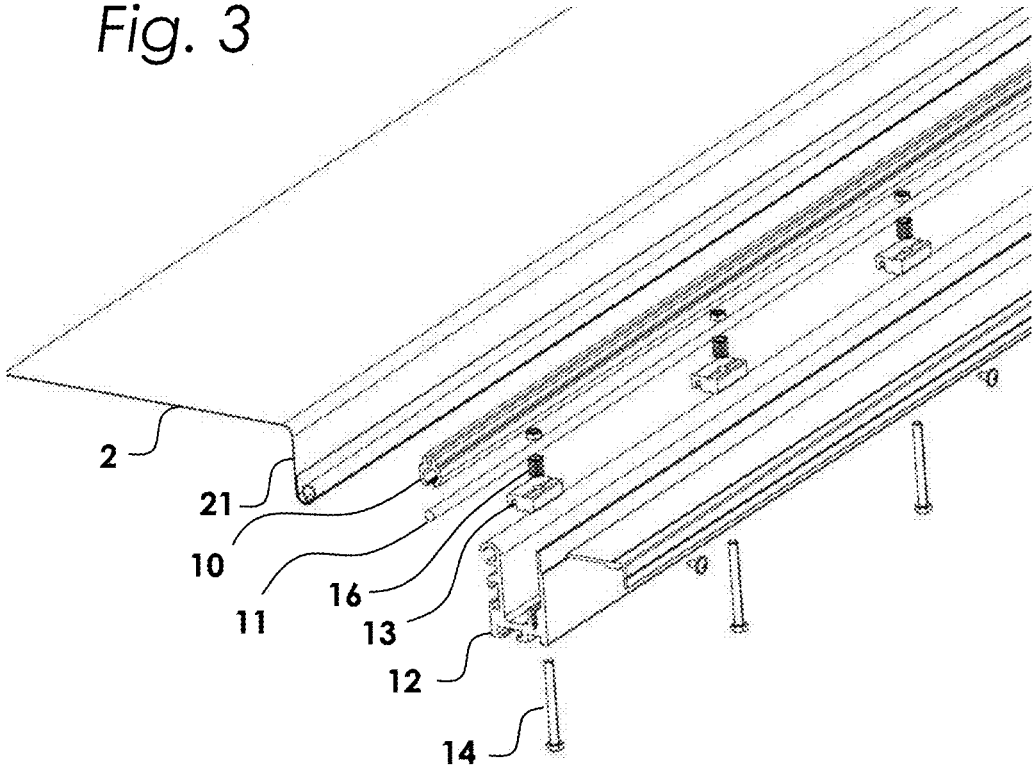

DEVICE FOR ATTACHING FLEXIBLE FABRICS FOR INDOOR AND OUTDOOR USE IN ARCHITECTURE

TECHNICAL FIELD

The present disclosure relates to a device for attaching flexible, flat fabric having a keder rail with a keder channel in which a keder core attached to the fabric is inserted.

BACKGROUND

According to the prior art, much is improvised when attaching of flexible, flat fabrics to structures. Types of attaching known from advertising technology or tent construction are commonly used in this case. These include so-called keder systems or use of eyelets which are pressed at the edges of the fabric at certain intervals. The major disadvantage is that systems for advertising technology are not designed for the 4 or 5 years of durability required in the construction (warranty obligation). The maximum durability in advertising technology amounts to 6 months without liability.

A type of beading is welded to the edges of the material in keder systems. The dimensions change through shrinkage during the welding process by welding alone. Dimensional errors can no longer be corrected. Since there are hardly any structures being constructed in which everything is built appropriately in angle and dimension, there are major problems in the prefabrication of the materials. Relatively often, the material must be disposed of and recreated due to incorrect dimensions.

The problem here is primarily that the contractor is professionally liable for the construction's lasting durability and function and at least the warranty obligation. This is not possible with the previously available solutions. An exception is extremely complex special steel structures in which the edges are indeed equipped with a keder profile, but then everything is diverted around the steel structure and attached behind it with screws. This effort is so great on textile facades that few builders can afford it. In addition, work space is always needed between the fabric and the structure for installation and maintenance. The structure often transgresses the approved construction limits, which leads to problems with the authorities or neighbors. Other alternative types of attachment (for example, the attachment of eyelets at the edges) fail during long-term use from the acting wind and suction loads. Stability is compromised as soon as a connection fails. A chain reaction of damage results.

SUMMARY

The present disclosure is based on the object of providing a device which eliminates the above problems and ensures that the flexible fabrics are to be attached on the construction such that they withstand all demands such as wind, suction, and ice loads and meet the required static conditions. The device must further ensure that there are no problems with the dimensions of the materials used when there is inaccuracy at the construction site. Furthermore, an attachment only at some points or one can damage the material is to be avoided, since otherwise the manufacturer's warranty does not apply. The materials for the construction require a biaxial test for approval in which the tear values are determined. It is therefore necessary not to endanger these values by the type of attachment, since otherwise the statics are wrong.

The above object is achieved by a device for attaching a flexible fabric which includes a receiving profile and a keder rail having a keder channel. The keder rail is arranged at a slidingly adjustable height on or in the receiving profile. A keder core is attached to the flexible fabric and inserted into the keder channel.

The device of the type mentioned above comprises at least one receiving profile, in/on which the at least one keder rail is arranged adjustable (relocatable) in height.

The receiving profile preferably consists of extruded aluminum, and has outside attachment grooves, with which the receiving profile can be slidably attached to lugs or angle brackets by means of commercially available hammer head screws.

The fabric is preferably threaded continuously on all four sides. A round aluminum pole is advantageously used as a keder core, which pole is wrapped in with the fabric. The fabric and the round tube form a beading, similar to the welded keder technology from the advertising industry.

The following detailed description of the invention is merely exemplary in nature and is not intended to limit the invention or the application and uses of the invention. Furthermore, there is no intention to be bound by any theory presented in the preceding background of the invention or the following detailed description of the invention.

BRIEF DESCRIPTION OF THE DRAWINGS

FIG. 2 shows the device in perspective view.

FIG. 3 shows the device in an exploded perspective view.

DETAILED DESCRIPTION

Figure 1:
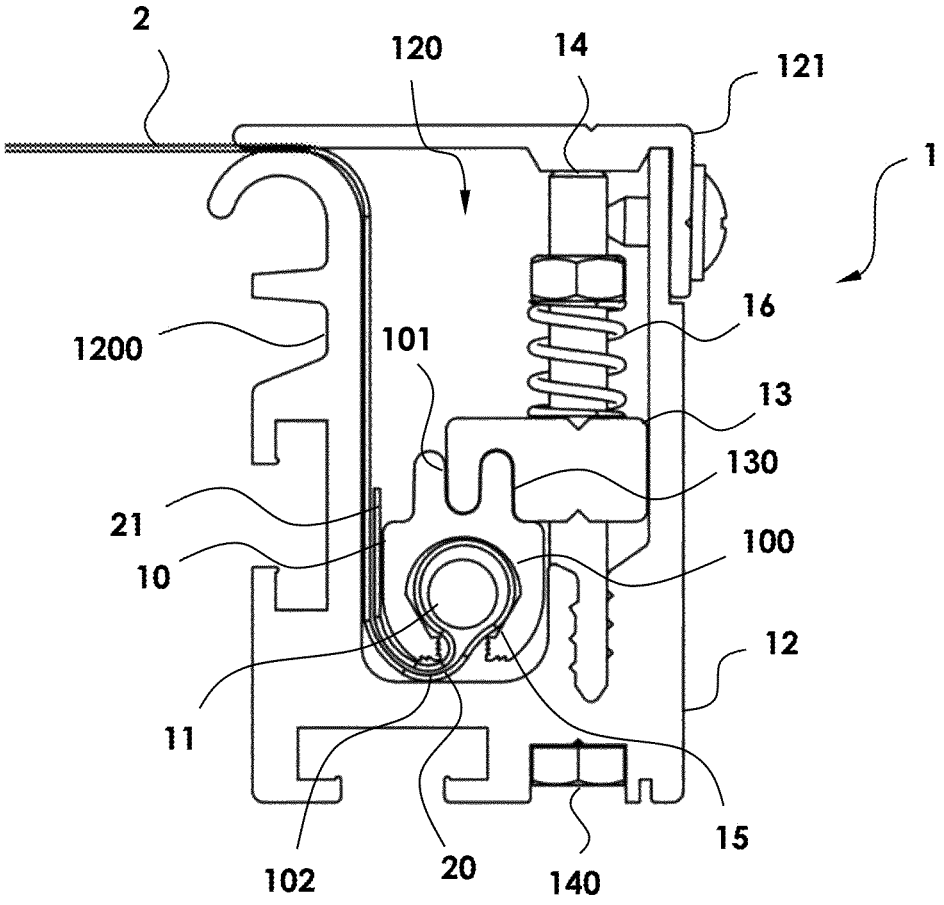
FIG. 1 shows a device for attaching a flexible fabric in side view.

Referring to FIG. 1, a device 1 for attaching a flexible fabric to a structure such as a building comprises a keder rail 10 having a keder channel 100. Inserted into the keder channel 100 is a keder core 11 attached to the fabric 2. A receiving profile 12 is also provided on the device 1. In the receiving profile the keder rail 10 is arranged relocatable in height, i.e. at an adjustable height.

The receiving profile 12 advantageously comprises a substantially U-shaped receptacle 120, in the upper region of which the fabric 2 is introduced. The fabric 2 is guided on a front side of the receiving profile 12 to the keder rail 10. The keder rail 10 is arranged in a lower region of the receiving profile 12. Furthermore, the receiving profile 12 preferably comprises a cover 121 reversibly arranged on the receptacle 120.

Particularly advantageously, the at least one keder rail 10 or an adjustment member 13 holding the at least one keder rail 10 is arranged on at least one threaded rod 14 or at least one threaded screw 14. The at least one threaded rod 14 or at least one threaded screw 14 is rotatably accommodated on the receiving profile 12. The keder rail 10 or the adjustment member 13 holding the keder rail 10 can be displaced in height by the at least one threaded rod 14 or at least one threaded screw 14.

It is advantageous in this case that the at least one threaded rod 14 or at least one threaded screw 14 comprises a head 140 which is accessible outside of the receiving profile 12. After engaging the head with a suitable tool the threaded rod 14 or the threaded screw 14 can be adjusted/rotated for adjusting the height of the keder rail 10.

As shown in FIG. 1, the keder rail 10 and the adjustment member 13 comprise corresponding engagements 101, 130, which provide a reversible, accurately fitting connection between the keder rail 10 and the adjustment member 13. Thus, the keder rail 10 can be easily and effortlessly introduced from below into the adjustment member 13.

The keder rail 10 is preferably arranged in the receiving profile 12 such that the keder channel 100 is aligned substantially in the direction opposite of the fabric 2 attached to the device 1. The keder channel 100 thus faces away from the fabric 2. Further, a fabric region 20 leading in the direction of the keder rail 10 and a fabric region end piece 21 protruding from the keder rail 10 are guided on an underside 102 of the keder rail 10 in such a way that these regions 20, 21 mutually jam. The advantage of this embodiment is to be seen in the fact that more or less of the fabric 2 can be wrapped and thus the dimensions of the entire fabric 2 can be easily influenced.

The fabric 2 in the keder channel 100 is held particularly advantageous by adjusting jaws 15 which press the keder rail 10 with the fabric 2 downward when adjusting the threaded rod 14 or the threaded screw 14 and thus provide an individually adjustable tension of the fabric 2.

Through rotation on the head 140, the adjusting jaws 15 then press the keder rail 10 with the fabric 2 downward and thus provide an individually adjustable tension of the fabric 2.

To mitigate peak wind loads, it may be advantageous that the keder rail 10 or adjustment member 13 holding the keder rail 10 is arranged spring-loaded on the threaded rod 14 or the threaded screw 14. A compression spring 16 may preferably be installed for this purpose. In addition, this spring provides automatic tension compensation in the event of temperature changes. This particularly material-preserving attaching method makes it possible to easily outlast the warranty periods required in the construction and significantly reduce assembly costs, for example, in textile facades.

The receiving profile 12 further comprises attachment grooves 1200, with which the receiving profile 12 is slidably attached on lugs or angle brackets by means of commercially available hammer head screws.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

LIST OF REFERENCE NUMBERS

1 device
2 fabric
10 keder rail
11 keder core
12 receiving profile
13 adjustment member
14 threaded screw
15 adjusting jaws
16 compression spring
20 fabric region
21 fabric region end piece
100 keder channel
101 engagement on the keder rail
102 underside of the keder rail
130 engagement on the adjustment member
120 U-shaped receptacle
121 cover
140 head
1200 attachment grooves

What is claimed is:

1. A device for attaching a flexible fabric, comprising:
a receiving profile;
a keder rail having a keder channel accessible through a longitudinal opening along a bottom of the keder rail, the keder rail being arranged at a slidingly adjustable height on or in the receiving profile; and
a keder core arranged within the keder channel,
wherein a lower portion of the keder channel has a cross sectional shape defined by flat jaw portions which are slanted towards the longitudinal opening,
wherein serrated grooves are formed in the longitudinal opening and on a bottom of the keder rail, and
wherein the flexible fabric loops around the keder core and, when tensioned, pulls the keder core towards the flat jaw portions.

2. The device according to claim 1, further comprising
a plurality of adjustment members arranged longitudinally spaced from one another and engaging a top of the keder rail,
wherein each adjustment member is connected to a threaded rod which is rotatably accommodated on the receiving profile or to a threaded screw which is rotatably accommodated on the receiving profile, and
wherein the height of the keder rail or a height of the adjustment member holding the keder rail can be adjusted by the least one threaded rod or the at least one threaded screw.

3. The device according to claim 2,
wherein the threaded rod or the threaded screw comprises a head which is accessible outside the receiving profile.

4. The device according to claim 2,
wherein the keder rail and the adjustment members comprise corresponding tongue and groove engagements which provide a separable, accurately fitting connection between the keder rail and the adjustment member.

5. The device according to claim 2,
wherein the adjustment members holding the keder rail are arranged spring-loaded on the threaded rod or the threaded screw.

6. The device according to claim 1, wherein
the flexible fabric enters the device along an outwardly bent arcuate upper portion of a side wall of the receiving profile,
follows the side wall of the receiving profile downward toward the keder rail,
enters the keder rail trough the longitudinal opening,
loops around the keder core,
exits the keder rail trough the longitudinal opening, and
upwardly follows the side wall of the receiving profile,
wherein the keder rail is arranged in the receiving profile such that the keder channel is facing away from the flexible fabric entering to the device.

7. The device according to claim 1,
wherein a fabric region leading in direction of the keder rail and a fabric region end piece protruding from the keder rail are guided on an underside of the keder rail so that they mutually jam each other.

8. The device according to claim 1,
wherein the receiving profile comprises a substantially U-shaped receptacle, in an upper region of which the flexible fabric is introduced and guided on a front side of the receiving profile to the keder rail which is arranged in a lower region of the receiving profile.

9. The device according to claim 8, wherein the receiving profile comprises a cover which is releasably arranged on the receptacle.

10. The device according to one of claim 8, wherein the receiving profile comprises attachment grooves with which the receiving profile can be slidably attached on lugs or angle brackets with hammer head screws.

11. The device according to claim 1, wherein the longitudinal opening faces a flat bottom of the receiving profile.

12. A device for attaching a flexible fabric, comprising:

a receiving profile;

a keder rail having a keder channel accessible through a longitudinal opening, the keder rail being arranged at a slidingly adjustable height in the receiving profile;

a keder core arranged within the keder channel;

a plurality of adjustment members arranged at a distance from one another and engaging a top of the keder rail through corresponding tongue and groove profiles, each adjustment member being slidingly arranged on a bolt and pushed towards a bottom of the receiving profile by a compression spring which is coaxially held on the bolt above the adjustment member; and a releasable cover closing off an upper portion of the receiving profile.

* * * * *